US005609469A

United States Patent [19]

Worley et al.

[11] Patent Number: 5,609,469

[45] Date of Patent: Mar. 11, 1997

[54] ROTOR ASSEMBLY SHROUD

[75] Inventors: Kevin L. Worley, Palm Beach Gardens, Fla.; Daniel E. Kane, Tolland, Conn.; Joseph H. Ewing, Jr., Lake Park; Arthur J. Van Suetendael, IV, Stuart, both of Fla.

[73] Assignee: United Technologies Corporation, Hartford, Conn.

[21] Appl. No.: 561,767

[22] Filed: Nov. 22, 1995

[51] Int. Cl.[6] ..... F01D 25/12

[52] U.S. Cl. ..... 415/173.1; 415/115

[58] Field of Search ..... 415/170.1, 173.1, 415/173.3, 115, 116

[56] References Cited

U.S. PATENT DOCUMENTS

| | | | |
|---|---|---|---|
| 4,050,843 | 9/1977 | Needham et al. | 415/116 |
| 4,144,433 | 3/1979 | Zelahy et al. | 219/9.5 |
| 4,416,585 | 11/1983 | Abdel-Messeh | 416/97 R |
| 4,551,064 | 11/1985 | Pask | 415/116 |
| 5,022,816 | 6/1991 | Maier et al. | 415/115 |
| 5,039,562 | 8/1991 | Liang | 427/276 |
| 5,127,793 | 7/1992 | Walker et al. | 415/115 |
| 5,167,485 | 12/1992 | Starkweather | 415/115 |
| 5,188,507 | 2/1993 | Sweeney | 415/173.3 |
| 5,197,853 | 3/1993 | Creevy et al. | 415/115 |
| 5,211,534 | 5/1993 | Catlow | 415/173.002 |
| 5,328,328 | 7/1994 | Charbonnel et al. | 415/170.1 |
| 5,333,992 | 8/1994 | Kane et al. | 415/138 |
| 5,395,212 | 3/1995 | Anzai et al. | 416/97 R |
| 5,423,659 | 6/1995 | Thompson | 415/173.1 |
| 5,486,090 | 1/1996 | Thompson et al. | 415/173.1 |

OTHER PUBLICATIONS

Han, J. C. Zhang, Y. M., and Lee, C. P., 1992, "Influence of Surface Heat Flux Ratio on Heat Transfer Augmentation in Square Channels with Parallel, Crossed, and V-Shaped Angled Ribs", ASME *Journal of Turbomachinery*, vol. 114, pp. 8872–880.

*Primary Examiner*—John Kwon
*Attorney, Agent, or Firm*—Richard D. Getz

[57] ABSTRACT

A shroud for a rotor assembly is provided comprising a mounting ring, an aft seal ring, a forward seal ring, and a blade outer air seal. The mounting ring is fixed within the casing surrounding the rotor assembly, and includes a first attachment apparatus. The blade outer air seal includes a plurality of body segments. Each body segment includes a first face, a second face, a plurality of passages for receiving cooling air disposed between the faces, a second attachment apparatus, and a post for biasing each the body segment in contact with the aft seal ring. The first and second attachment apparatus cooperate to suspend the blade outer seal segments in close proximity to the rotor assembly.

10 Claims, 2 Drawing Sheets

ROTOR ASSEMBLY SHROUD

The invention was made under a U.S. Government contract and the Government has rights herein.

BACKGROUND OF THE INVENTION

1. Technical Field

This invention relates to turbine engine rotor assemblies in general, and to rotor assembly shrouds in particular.

2. Background Information

A typical gas turbine engine includes a fan, compressor, combustor, and turbine disposed along a common longitudinal axis. The fan and compressor sections work the air drawn into the engine, increasing the pressure and temperature of the air. Fuel is added to the worked air and burned within the combustor. The combustion products and any unburned air, hereinafter referred to as core gas flow, subsequently powers the turbine and exits the engine producing thrust. In most cases, the turbine comprises several stages each having a rotor assembly and at least one stationary vane assembly. The core gas flow causes the rotor assemblies to rotate, thereby enabling the rotor assemblies to do work elsewhere in the engine. The stationary vane assemblies located forward and/or aft of the rotor assemblies guide the core gas flow entering and/or exiting the rotor assemblies.

A shroud is disposed radially outside of the rotor assembly for sealing between the turbine case and the rotor assembly. The shroud includes a blade outer air seal generally formed from a plurality of segments disposed side by side around the circumference of the rotor assembly. The blade outer air seal segments are suspended in close proximity to the tips of the rotor blades.

The extremely high temperature of the core gas flow passing through the turbine necessitates cooling within many of the turbine components. This is particularly true for blade outer air seals. The shroud components are cooled by air bled off the compressor at a temperature lower and a pressure greater than that of the core gas flow. There is a trade-off using compressor worked air for cooling purposes, however. On the one hand, the bled air cools where access is provided and the higher pressure of the bled air prevents detrimental in-flow of hot core gas. On the other hand, air bled off of the compressor does not do as much work as it might otherwise and consequently decreases the efficiency of the engine. This is particularly true when excessive bled air is used for cooling purposes because of undesirable leaks in the cooling path.

Blade outer air seal segments may be biased within the shroud to ensure proper sealing between the blade outer air seal and whatever hardware is adjacent the seal, and to prevent detrimental vibration. Vibration can cause blade outer air seal segments to wear prematurely. Some prior art shrouds use a ring to aggregately bias the blade outer air seal segments around the circumference of the shroud. A difficulty with this approach is that segments will vary in size within their tolerance range. If, in the assembly of the shroud, several "full" segments are placed adjacent a "thin" segment, the biasing force of the ring may not be applied to the thin segment as completely as it is applied to the full segments. As a result, a space between the thin segment and the ring may be created that provides an undesirable leak path for bled air. In addition, the thin segment may be more readily excited, and therefore prone to vibration.

The leakage and vibration problems caused by the tolerance range of the segment widths can be resolved by machining all of the segments together as an assembly to produce a single machined surface. Machining the blade outer air seal as an assembly is, however, a difficult and expensive task. In addition, if one or more of the "machined" blade outer air seal segments later needed to be replaced, that replacement would have to be custom machined as well.

Hence, what is needed is a rotor assembly shroud that uses a minimum of bled air, one that is durable, one that is easily maintained, and one that utilizes readily replaceable pans.

DISCLOSURE OF THE INVENTION

It is, therefore, an object of the present invention to provide a rotor assembly shroud that includes adequate cooling means.

It is another object of the present invention to provide a rotor assembly shroud that minimizes leakage of bled air from the shroud.

It is still another object of the present invention to provide a rotor assembly shroud having a blade outer air seal that does not appreciably vibrate, if at all.

It is still another object of the present invention to provide a rotor assembly shroud with optimal heat transfer, and therefore minimal cooling air requirements.

It is still another object of the present invention to provide a rotor assembly shroud that is easily manufactured and assembled.

It is still another object of the present invention to provide a rotor assembly shroud having blade outer air seals that are readily replaceable.

According to the present invention, a shroud for a rotor assembly is provided comprising a mounting ring, an aft seal ring, a forward seal ring, and a blade outer air seal. The mounting ring is fixed within the casing surrounding the rotor assembly, and includes a first attachment means. The blade outer air seal includes a plurality of body segments. Each body segment includes a first face, a second face, a plurality of passages for receiving cooling air disposed between the faces, a second attachment means, and a post for biasing each body segment in contact with the aft seal ring. The first and second attachment means cooperate to suspend the blade outer seal segments in close proximity to the rotor assembly.

According to one aspect of the present invention, means for augmenting the transfer of heat within the passages is provided disposed within the passages.

According to another aspect of the present invention, opposite edges of the blade outer air seal segments form mating shiplap halves. Cooling passages are disposed within the mating shiplap halves to prevent thermal damage.

An advantage of the present invention is that the bled air leakage and vibration of blade outer seal segments are minimized. The post extending out from each blade outer air seal segment biases each segment individually against the aft seal ring. Vibration and any gap that may have existed between the segment and the aft seal ring are therefore minimized.

Another advantage of the present invention is the increased mechanical protection and thermal resistance provided by the cooled shiplap joints formed between adjacent blade outer air seal segments. The shiplap pairs help maintain the integrity of the blade outer air seal in the event of contact between the rotor blades and the blade outer air seal. The shiplap pairs also protect the feather seals extending between adjacent blade outer air seal segments. The cooling passages within each body segment extend into the inner and outer halves of each shiplap pair to transfer heat away from the shiplap pairs.

Still another advantage of the present invention is that the cooling air requirements of the shroud overall, and the blade outer air seal in particular, are minimized. The means for augmenting heat transfer, disposed within the passages of each segment, increases the rate of heat transfer in the passages. Hence, less cooling air is required to provide the necessary amount of heat transfer.

Still another advantage of the present invention is that the shroud is more readily manufactured, assembled, and maintained. Biasing the blade outer air seal segments individually obviates the need to machine the segments collectively, and allows a greater tolerance range for the width of each individual segment. In addition, worn segments can later be replaced without having to custom fit the particular segments.

These and other objects, features and advantages of the present invention will become apparent in light of the derailed description of the best mode embodiment thereof, as illustrated in the accompanying drawings.

BEST MODE FOR CARRYING OUT THE INVENTION

Figure 1:
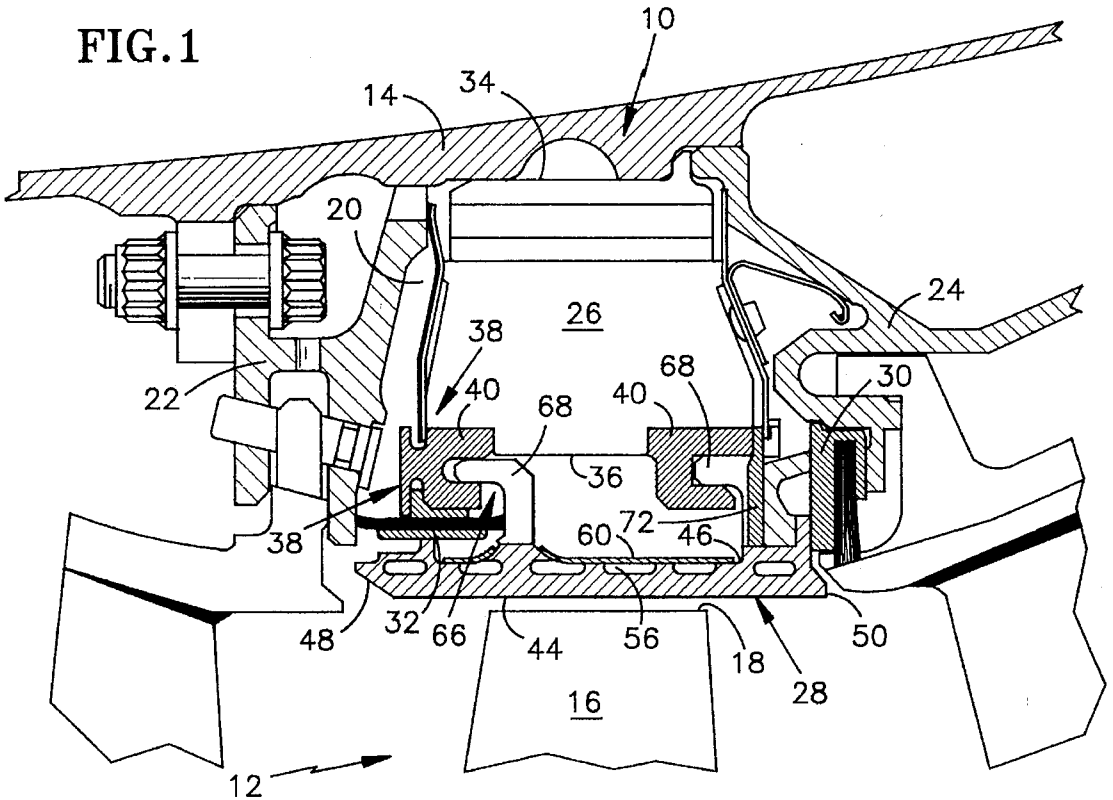
FIG. 1 is a diagrammatic sectional view of the shroud disposed within the casing.

Referring to FIG. 1, a shroud 10 is disposed between a rotor assembly 12 and the casing 14 surrounding the rotor assembly 12 within the turbine of a gas turbine engine (not shown). The rotor assembly 12 includes a plurality of blades 16 circumferentially disposed around a disk (not shown). The outer radial surface 18 of each blade may be referred to as the tip 18.

The shroud 10 is disposed in an annulus 20 radially between the casing 14 and the blade tips 18 of the rotor assembly 12, and axially between forward 22 and aft 24 outer vane supports. The shroud 10 includes a mounting ring 26, a blade outer air seal 28, an aft seal ring 30, and a forward seal ring 32. The mounting ring 26 includes an outer 34 and an inner 36 radial surface. A press fit between the outer radial surface 34 and the casing 14 fixes the mounting ring 26 within the casing 14. The mounting ring 26 further includes a first attachment means 38 which includes a plurality of "L"-shaped flanges 40 extending out from the inner radial surface 36.

Figure 2:
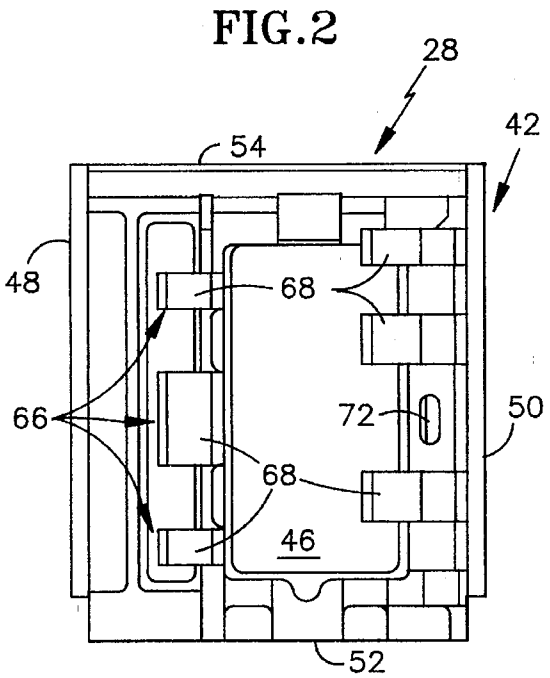
FIG.2 is a diagrammatic top view of a blade outer air seal segment.
Figure 3:
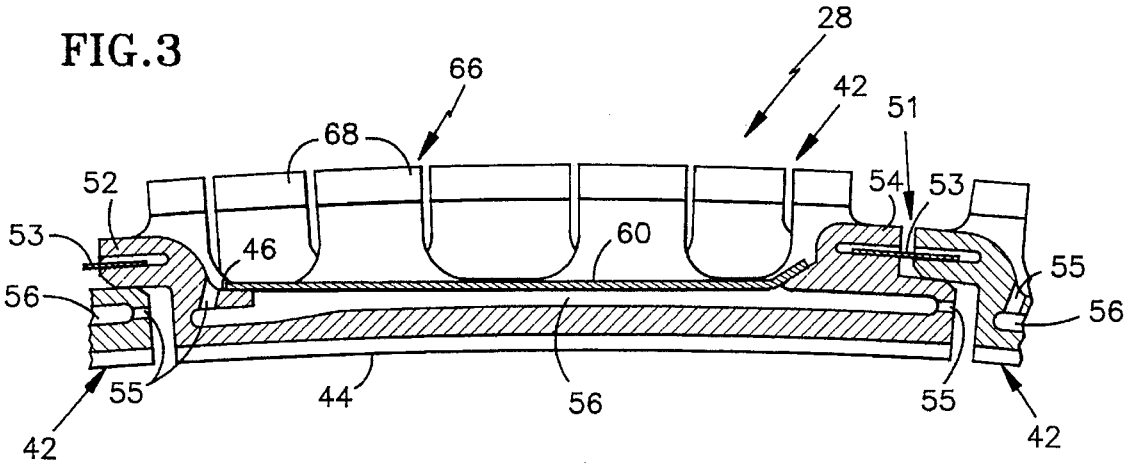
FIG.3 is a diagrammatic sectional view of blade outer air seal segments.
Figure 4:
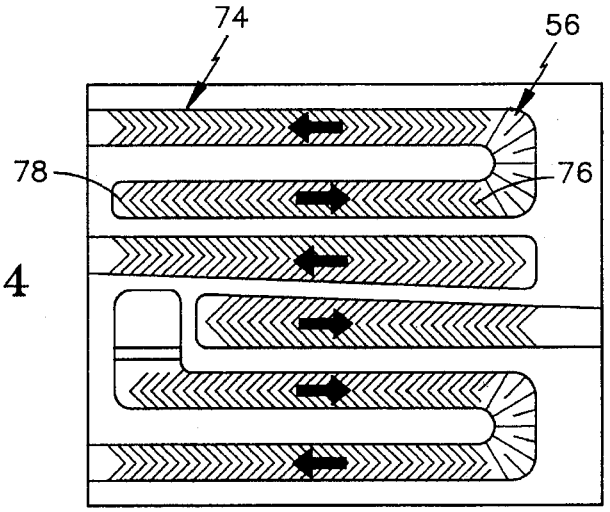
FIG.4 is a diagrammatic view of the passages within a blade outer seal segment.

Referring to FIGS. 2–4, the blade outer air seal 28 is formed from a plurality of body segments 42 connected to one another, which collectively form a ring suspended by the mounting ring 26 (see FIG. 1) around the periphery of the rotor assembly 12. Each body segment 42 includes a first face 44, a second face 46, a forward edge 48, an aft edge 50, a first 52 and a second 54 circumferential edge, and a plurality of passages 56. In a first embodiment, the passages 56 are formed from channels disposed in the second face 46 with one or more plates 60 secured to the second face 46 to close the channels into passages 56. In a second embodiment, the passages 56 are formed internally within the segment 42, between the first 44 and second 46 faces. The first 52 and a second 54 circumferential edges are formed as mating shiplap joint halves, respectively (see FIG.3). The passages 56 extend into the shiplap halves 52,54 and include ports 55 which allow cooling air to pass through the shiplap halves 52,54 and outside of the segment 42. Each shiplap half 52,54 mates with the half from the adjacent segment 42 to form the shiplap joint 51. Feather seals 53 extend between adjacent segments 42 to prevent leakage between segments 42.

Referring to FIG. 1, each blade outer air seal segment 42 includes a second attachment means 66 having a plurality of upside down "L"-shaped flanges 68 extending out from the second face 46 of each segment 42. The flanges 68 extending out from the segments 42 cooperate with the flanges 40 extending out from the mounting ring 26 to suspend the segments 42.

Each blade outer air seal segment 42 further includes a post 72 for biasing each segment 42 within the shroud 10. The post 72 extends out from the second face 46 of the segment 42, adjacent the aft edge 50 of the segment 42. The height of the post 72 is such that the post 72 contacts the mounting ring 26 once the shroud 10 is assembled. The post 72 provides a defined spring force for a specific amount of deflection.

Referring to FIG.4, means 74 for augmenting heat transfer within the passages 56 may be included within the passages 56. In the preferred embodiment, the means 74 for augmenting includes a plurality of chevron shaped fins 76 extending into the passages 56. The crowns 78, or points, of the chevron shaped fins 76 are directed against the flow path of bled air within the passages 56 as is shown by the directional arrows in FIG.4.

Referring to FIG. 1, the forward 32 and aft 30 seal rings are brush seals positioned to seal between blade outer air seal 28 and the forward 22 and aft 24 outer vane supports, respectively. The forward seal ring 32 is positioned between the blade outer air seal 28, the mounting ring 26, and the forward outer vane support 22. The aft seal ring 30 is positioned between the blade outer air seal 28 and the aft outer vane support 24. The aft outer vane support 24 biases the aft seal ring 30 against the blade outer air seal 28, thereby aggregately biasing the second attachment means 66 of the blade outer air seal segments 42 within the first attachment means 38 of the mounting ring 26. The post 72 extending out from the second face 46 of each segment 42 biases each individual segment 42 against the aft seal ring 30.

During operation of the engine, core gas flow passes through the engine and more specifically past the rotor assembly 12 within the turbine. The core gas flow drives the rotor assembly 12 and the rotor assembly, in turn, drives the compressor (not shown). Air bled off of the compressor upstream of the turbine, at a temperature lower and a pressure higher than that of the core gas flow, is passed through the casing 14 to cool the casing 14 and the shroud 10.

Referring to FIG.3, because a significant percentage of the work imparted to the air by the compressor is lost when used for cooling purposes, it is a considerable advantage to minimize the amount of bled air required for cooling purposes. A first method for minimizing the use of bled air is to use the bled air effectively. The cooling passages 56 extending into the shiplaps 52, 54 help protect the shiplaps with a minimal amount of bled air. The chevrons fins 76 disposed within the passages 56 similarly help to optimize the heat transfer between the blade outer air seal segments 42 and the bled air passing through the passages 56.

Referring to FIG. 1, the second method, preventing bled air leakage, is accomplished by the posts 72 extending out from the second face 46 of each blade outer seal segment 42. The blade outer air seal segments 42 are aggregately biased against the mounting ring 26 by the aft outer vane support 24 acting against the aft seal ring 30. The posts 72 extending out from the segments 42, adjacent the aft edge 50, resist the loading of the aft outer vane support 24 and bias each individual segment 42 against the aft seal ring 30. In the event a "thin" width segment 42 is positioned next to one or more "full" segments 42, the individual biasing provided by the posts 72 ensures that the "thin" segment 42 is biased against the aft seal ring 30. As a result, any leakage that might have occurred between the individual segment 42 and the aft seal ring 30 due to tolerancing is minimized, as well as any detrimental vibration.

Although this invention has been shown and described with respect to the detailed embodiments thereof, it will be understood by those skilled in the art that various changes in form and detail thereof may be made without departing from the spirit and the scope of the invention. For example, it is disclosed in the best mode that aft seal ring biases the blade outer seal ring. In alternative embodiments, other surfaces may be used to bias the blade outer air seal.

We claim:

1. A shroud for a rotor assembly, comprising:

a mounting ring, fixed within a casing, said mounting ring having a first attachment means;

an aft seal ring; and a blade outer air seal, including:

a plurality of body segments, each said body segment having a first face, a second face, and a plurality of passages for receiving cooling air disposed between said faces;

a second attachment means, extending out from said second face of each said segment, wherein said first and second attachment means cooperate to suspend said blade outer air seal from said mounting ring; and a post, for biasing each said body segment in contact with said aft seal ring, said post extending out from said second face of each said segment.

2. A shroud according to claim 1, further comprising means for augmenting the transfer of heat within said passages.

3. A shroud according to claim 2, wherein said means for augmenting the transfer of heat within said passages comprises a plurality of chevron shaped fins disposed within said passages.

4. A shroud according to claim 3, wherein each said body segment further comprises:

a first edge, formed as a first half of a mating shiplap pair;

a second edge, opposite said first edge, formed as a second half of a mating shiplap pair;

wherein said first edge of a first body segment mates with said second edge of a second body segment to join said body segments.

5. A shroud according to claim 4, wherein each said body segment further comprises passages extending into said halves of said mating shiplap pairs, said passages permitting cooling air into said mating shiplap halves.

6. A blade outer air seal for a rotor assembly shroud, comprising:

a plurality of body segments, each said body segment having a first face, a second face, and a plurality of passages for receiving cooling air disposed between said faces;

means for suspending each said segment within the shroud, said means for suspending extending out from said second face of each said segment;

means for biasing each said body segment within the shroud, said means for biasing extending out from said second face of each said segment; and means for augmenting the transfer of heat within said passages.

7. A blade outer air seal according to claim 6, wherein each said body segment further comprises:

a first edge, formed as a first half of a mating shiplap pair;

a second edge, opposite said first edge, formed as a second half of a mating shiplap pair;

wherein said first edge of a first body segment mates with said second edge of a second body segment to join said body segments.

8. A blade outer air seal according to claim 7, wherein said means for biasing each said body segment within the shroud comprises:

a post, extending out from said second face of said body segment for engagement within the shroud;

wherein assembly of said blade outer air seal within the shroud causes said post to deflect, thereby biasing said body segment within the shroud.

9. A blade outer air seal according to claim 8, wherein said means for augmenting the transfer of heat within said passages comprises a plurality of chevron shaped fins extending into said passages.

10. A blade outer air seal according to claim 9, wherein said means for suspending said blade outer air seal comprises:

a plurality of first flanges extending out from said second face side;

a plurality of second flanges extending out from said second face side;

wherein said flanges are shaped such that they form a sideways "U" shape with said second face side.

* * * * *